US009664103B2

(12) United States Patent
Wacholtz, Jr.

(10) Patent No.: US 9,664,103 B2
(45) Date of Patent: May 30, 2017

(54) VIRTUAL VARIABLE DISPLACEMENT TWO-STROKE INTERNAL COMBUSTION PISTON ENGINE

(71) Applicant: John E Wacholtz, Jr., Plano, TX (US)

(72) Inventor: John E Wacholtz, Jr., Plano, TX (US)

( * ) Notice: Subject to any disclaimer, the term of this patent is extended or adjusted under 35 U.S.C. 154(b) by 61 days.

(21) Appl. No.: 14/821,717

(22) Filed: Aug. 8, 2015

(65) Prior Publication Data

US 2017/0037772 A1 Feb. 9, 2017

(51) Int. Cl.

| | |
|---|---|
| ***F01L 3/10*** | (2006.01) |
| ***F02B 25/14*** | (2006.01) |
| ***F02B 75/02*** | (2006.01) |

(52) U.S. Cl.

CPC ..... *F02B 25/145* (2013.01); *F02B 75/02* (2013.01); *F02B 2075/025* (2013.01)

(58) Field of Classification Search

CPC .. F02B 25/145; F02B 75/02; F02B 2075/025; F02B 1/04; F02B 1/06; F02B 1/08; F02B 1/10; F02M 27/00; F02M 25/10; F02M 25/12; F01L 3/10

USPC ..... 123/73 C, 65 PE, 65 V, 65 EM, 65 P, 123/1 A, 536, 538, 539, 525, 431, 90.11, 123/198 A, 575, 65 VD

See application file for complete search history.

(56) References Cited

U.S. PATENT DOCUMENTS 2,620,125 A * 12/1952 Kilchenmann ..... F04B 11/0025 123/65 V
6,651,599 B2 * 11/2003 Wechner ..... F01L 11/02 123/46 R
8,794,198 B2 * 8/2014 Cockerill ..... F01B 11/001 123/46 A

* cited by examiner

*Primary Examiner* — Hai Huynh
(74) *Attorney, Agent, or Firm* — Chen-Chi Lin

(57) ABSTRACT

A true two-stroke (power and exhaust) internal combustion piston engine combining direct injection of all combustion and working fluid elements with exhaust valve(s) that open early during the power stroke if cylinder pressure falls below exhaust manifold pressure, will operate efficiently from power levels produced by conventional four-stroke engines of a fraction of the displacement of the two-stroke engine to power levels attainable by conventional four-stroke engines of twice the two-stroke engine displacement. No additional external systems will be required to enhance performance or control emissions, as all such enhancements are equivalent to control of the combustion and working fluid components. The magnitude of the combustion charge determines the power, and the makeup of the combustion components determine exhaust emissions. Any implementation of the true two-stroke engine will have the further advantages of requiring only half the cylinders (space and weight) and an equivalent reduction in required support systems. No intake valve train, no intake filter or manifolds, no catalytic converter or exhaust gas recirculation will be required. Some implementations may eliminate other support systems entirely (starter, cooling, exhaust valve train, etc.)

9 Claims, 6 Drawing Sheets

PRIOR ART

PRIOR ART

VIRTUAL VARIABLE DISPLACEMENT TWO-STROKE INTERNAL COMBUSTION PISTON ENGINE

BACKGROUND OF THE INVENTION

This invention relates to a true two-stroke (power and exhaust) internal combustion piston engine combining direct injection of all combustion and working elements with exhaust valve(s) that open early during the power stroke if cylinder pressure falls below exhaust manifold pressure.

With the exception of certain engines designed for applications where ambient atmosphere is not available (such as submerged submarines), all internal combustion engines in wide use rely on ambient atmosphere to provide both the oxidizer and primary working fluid for converting heat of combustion to mechanical force. Even engines used in submerged submarines use the same cycle and dynamics as conventional engines with added components/controls to replace the ambient atmosphere that is not available (compressed air tanks or oxygen plus inert gas).

The power and efficiency of conventional internal combustion engines is largely a function of how much ambient air can be compressed into a cylinder to react with the appropriate amount of fuel. Thus large amounts of power can be generated using a large-displacement, normally aspirated engine or a much smaller displacement engine with additional components and systems to maximize the air forced into the cylinder(s). As ambient air is used, all the mechanical/other methods to place the air into the cylinder and compress the air must be on the vehicle and some amount of the mechanical force from the engine must be used to compress the air drawn into the engine.

Because the same cylinder is used to take in the ambient air and compress it to efficient pressure, the effective displacement is the total displacement of the piston travel. The most efficient operating region is near full power, and thus the required displacement of a given engine/vehicle combination is often determined by the maximum power desired even though the maximum power is seldom used or efficient in normal use.

The use of ambient air is the source of many other problems confronting conventional internal combustion engine designers. Ambient air consists largely of nitrogen and oxygen but may also contain any number of local variations from humidity to pollutants. Nitrogen limits the thermodynamic efficiency of the engine because it limits the temperature of combustion to control undesirable nitrogen-oxygen compounds in exhaust products. These and other undesirable byproducts require exhaust catalysts to remove or change the exhaust before it is vented into the atmosphere.

Great strides have been made in the design of modern internal combustion engines to address the efficiency and maintain clean operating characteristics but the limits to using ambient atmosphere as oxidizer/working fluid are close. A step beyond will be required to reach the next level of advancement.

In the 1970s several patents suggested using non-atmospheric oxidizers with otherwise conventional engines as a method of addressing atmospheric pollution. These patents included suggestions of the possibility of a two-stroke engine implemented in this manner with conventional intake and exhaust valve operation. No commercial product appears to have resulted from these inventions.

BRIEF SUMMARY OF THE INVENTION

A conventional engine block, crank, rod and piston set (of one or multiple cylinders) is combined with cylinder head(s), which have multiple injectors (per cylinder) to force fuel, working fluid and oxidizer into the cylinder(s) and one or more exhaust valves (per cylinder) to allow combustion products to exit the cylinder(s) when spent, and;

A method of providing high pressure fuel, working fluid and oxidizer to the injectors on demand, and;

A timing system to open the injectors at the proper time in the piston rotation, and;

A timing system to open the exhaust valve(s) from the end of the virtual/real power stroke (when the pressure within the cylinder drops below ambient exhaust pressure or at bottom dead center (BDC)) and to close the exhaust valves at the beginning of injection of combustion elements near top dead center (TDC) and during the power stroke.

A cycle begins with the injection of fuel, oxidizer and working fluid near TDC. The exhaust valve(s) has been forced closed and ignition and expansion transfer pressure to the piston. When the charge is fully expended and pressure drops below exhaust manifold pressure or near BDC regardless of pressure, the exhaust valve opens to allow free flow from the cylinder into the exhaust manifold. Near TDC, the exhaust valve is forced to close and the injection of combustion components begins the next cycle.

Maximum efficient power and use of combustion elements occurs when the exhaust valve would open by lack of pressure at the same point as forced open near BDC. Slightly reduced efficiency will occur when the exhaust valve opens earlier due to reduced charge. Less efficiency but large increases in power will occur when excess charge is injected and increased pressure occurs throughout the power stroke.

DETAILED DESCRIPTION OF THE INVENTION

Figure 1:
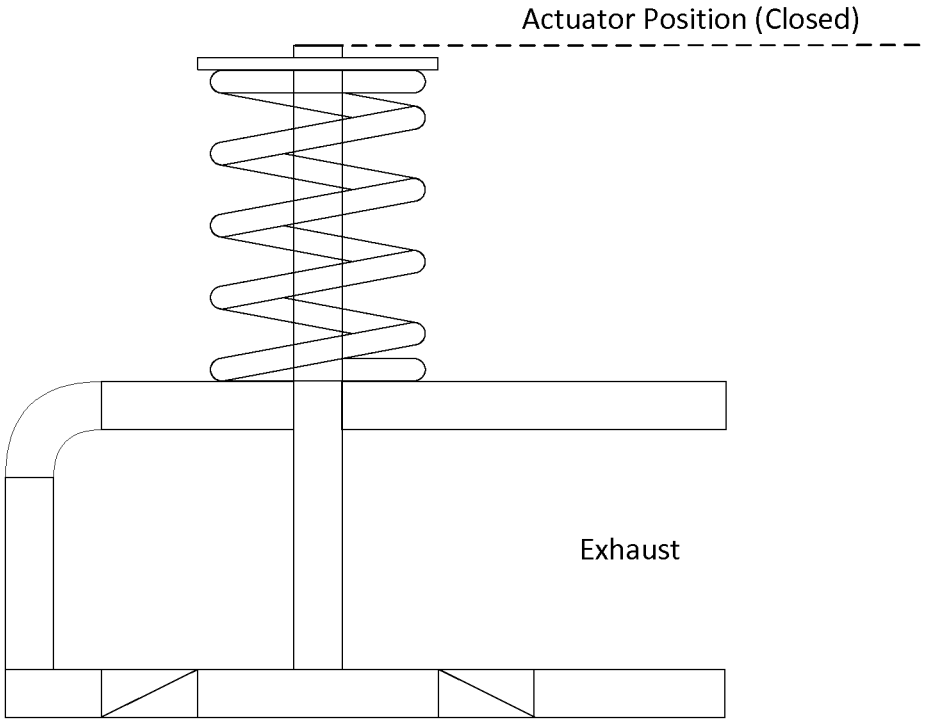
FIG. 1. Prior Art—Actuator Position Closed
Figure 2:
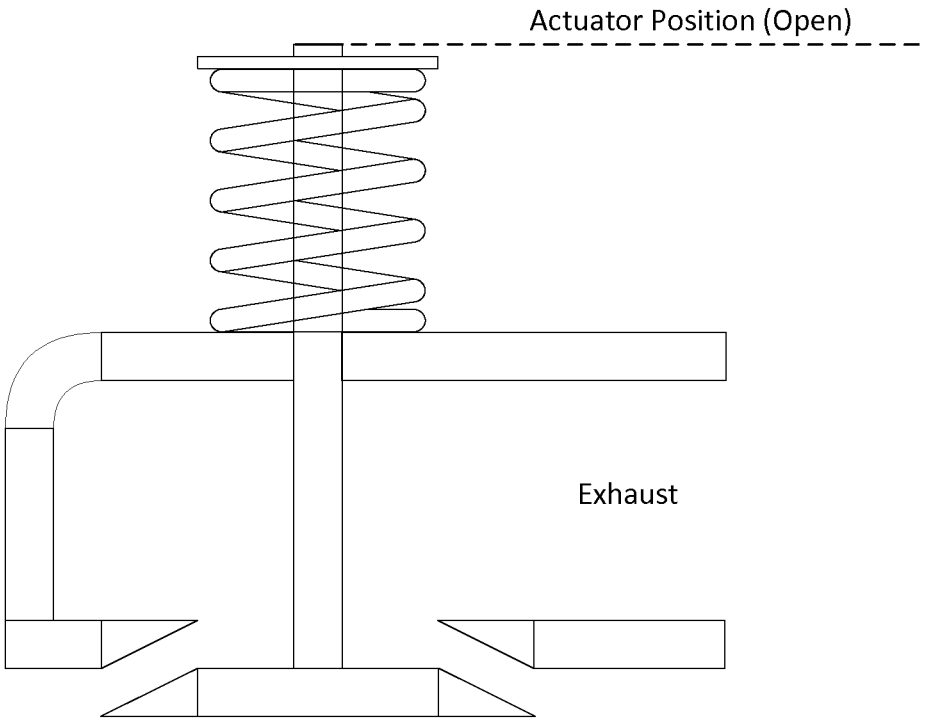
FIG. 2. Prior Art—Actuator Position Open
Figure 3:
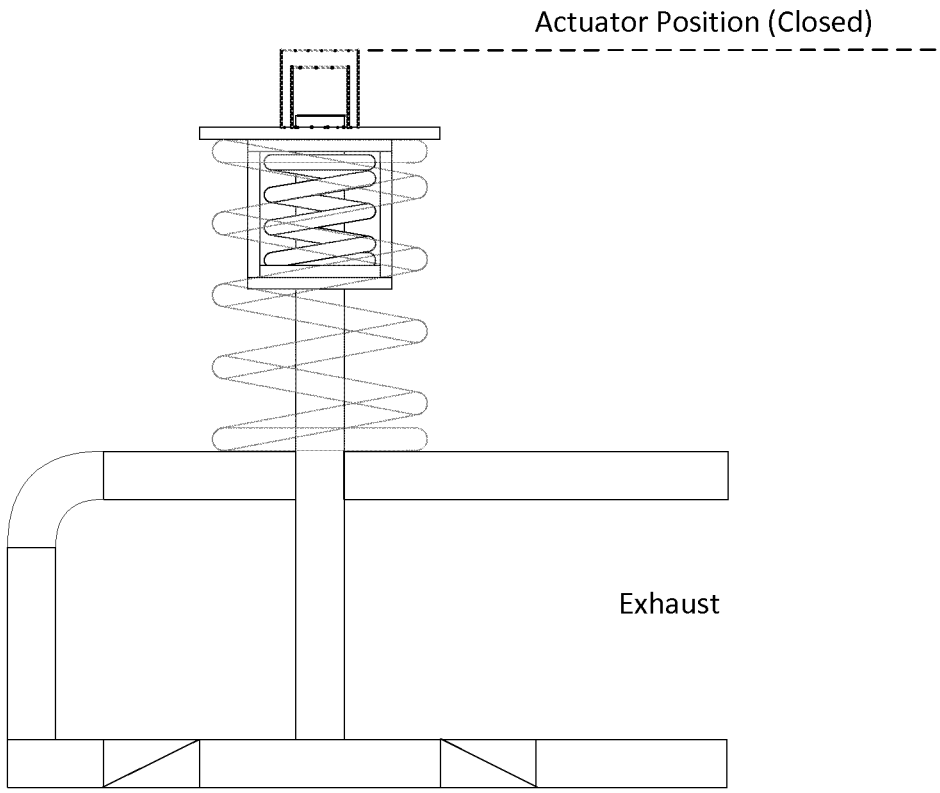
FIG. 3. Modified Exhaust Valve—Actuator Position Forced Closed
Figure 4:
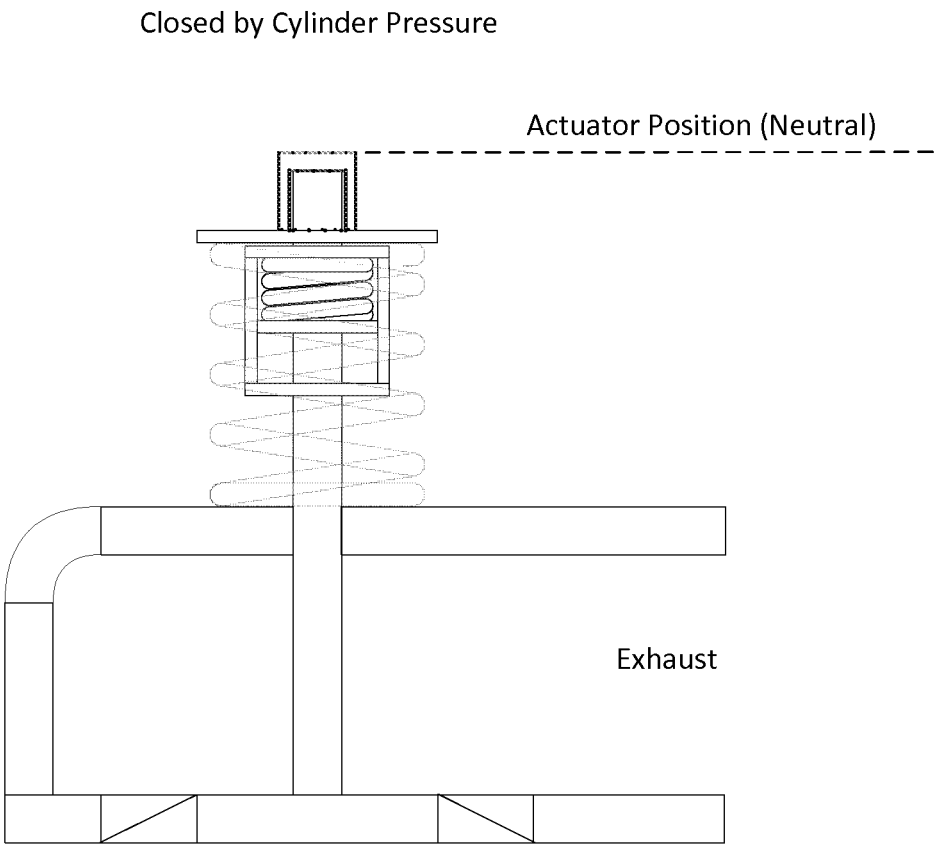
FIG. 4. Modified Exhaust Valve—Actuator Position Neutral—Valve closed by elevated cylinder internal pressure FIG. 5. Modified Exhaust Valve—Actuator Position Neutral—Valve open due to reduced cylinder internal pressure FIG. 6. Modified Exhaust Valve—Actuator Position Forced Open
Figure 5:
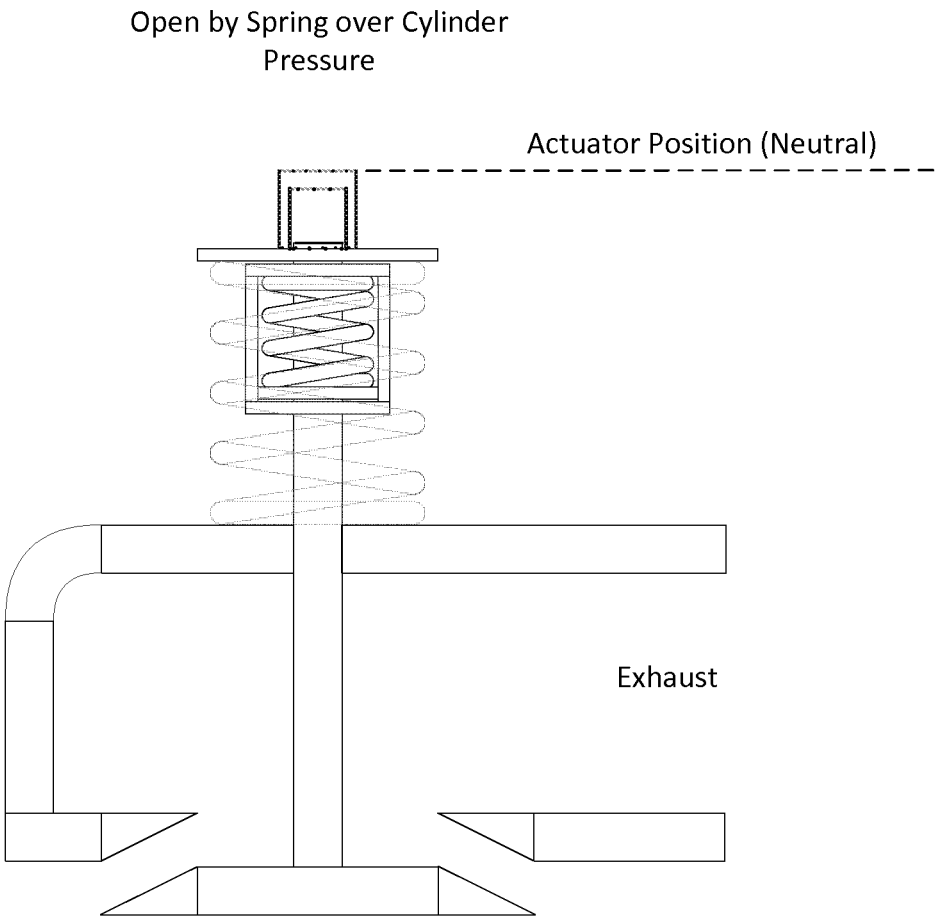
Figure 6:
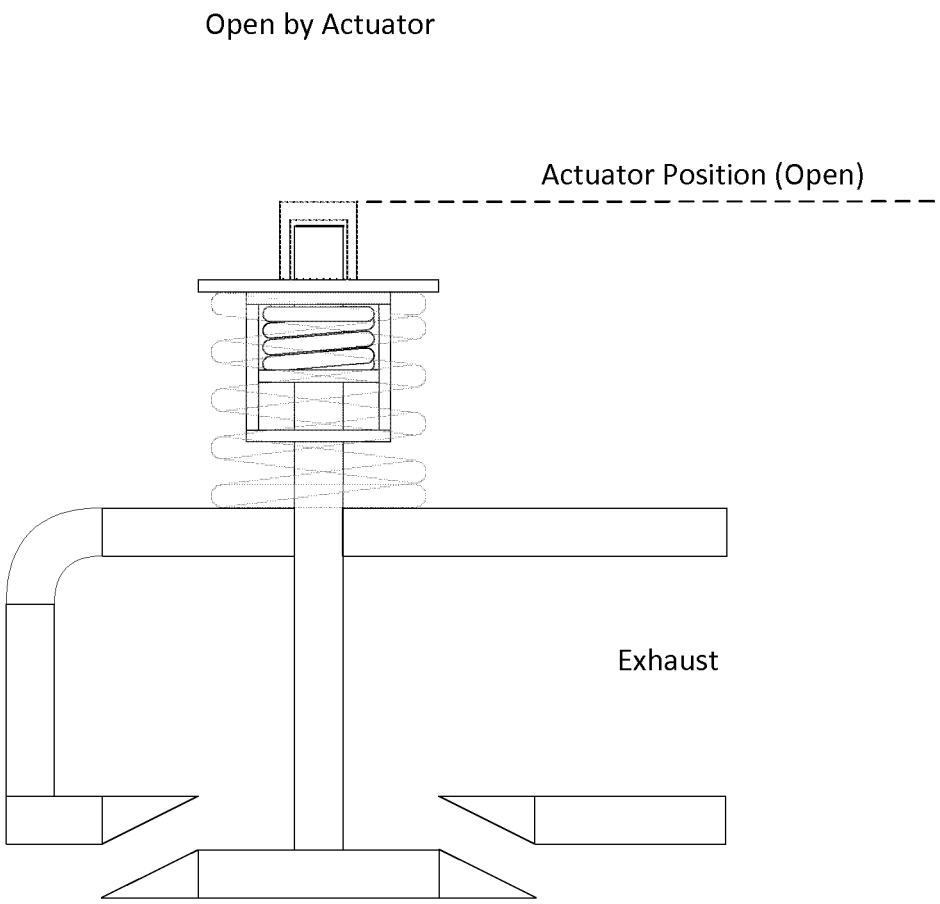

The invention consists of one or more cylinders in an engine block with a conventional crankshaft, piston rods and pistons. The cylinder heads include multiple injectors per cylinder for fuel, oxidizer and, if necessary, working fluid injection. The cylinder heads also include one or more exhaust valves per cylinder activated either mechanically with a valve train and modified valves (FIG. 1 through FIG. 6), by solenoid set to allow valve opening when deactivated, or other means. Timing is taken from the movement of the crank either mechanically or electronically. Ignition will be initiated with a spark plug or other conventional means. Solenoid activation of the exhaust valve(s) would be preferred over a mechanical exhaust valve train because the variable open position during the power stroke could be implemented with the neutral (not forced closed or open) position of the solenoid, and no additional springs or sleeved shaft would be required.

While it is possible with some exotic fuels to have only one injector, the best and safest implementation is to have high pressure oxygen, provided by warming cryogenic liquid oxygen in ambient heat initially and then by waste heat of combustion into a gas, passing the gaseous oxygen through one injector, the high pressure fuel through another injector and the working fluid (to replace the nitrogen in air) either mixed with the fuel or oxygen and passed through that injector or passed through a third injector.

Use of cryogenic oxygen as the oxidizer allows the use of excess heat from combustion to expand and pressurize the oxygen and also reduce the heat given off by the process into the local environment. The block will be designed to transfer heat from the cylinders to the expansion chamber as well as to maintain a seal on high pressure oxygen within the chamber. The expansion chamber may be a sleeve around the cylinders in the block (similar to conventional cooling systems without the radiator, pump or hoses).

Depending on the fuel, there will have to be approximately 1.5 times the volume and approximately twice the weight of cryogenic oxygen as fuel (hydrocarbon fuel assumption). Other fuels or oxidizers will require different relative amounts.

If there are multiple cylinders with connections displaced evenly around a crankshaft, such that one cylinder will always be in the forced-closed exhaust valve portion of the power stroke, then starting the engine will consist of the injection of a charge into the available cylinder and initiating combustion. The other cylinders will enter the cycle at the correct time, have injection and ignition, and provide power thereafter. This configuration should require no "starter motor".

Upon starting of the engine, each cycle of each cylinder shall consist of a power stroke and an exhaust stroke. The power stroke begins near TDC and ends when the charge is exhausted (when running on reduced power settings) or when the exhaust valve is forced open (near BDC). The exhaust stroke begins when the exhaust valve opens (either due to pressure drop or by being forced) and ends near TDC prior to the next charge injection.

When the engine is running at low power, the efficiency will remain high (similar to a smaller engine) because a reduced charge enters the piston and nothing resists the piston continuing past the reduced pressure opening. Thus at low power levels the engine will gain the benefit of running at nearly full the efficiency of a reduced displacement engine near full output.

The maximum power output of this engine will be nearly twice that of a conventional four-cycle engine of equal displacement. The equivalent power of a given displacement conventional engine could be provided by an engine with only half the displacement because power is produced by each revolution of the piston rather than one revolution out of two. Power output should also exceed conventional two-cycle engines of similar displacement because a portion of the power and exhaust strokes on conventional two-stroke engines must still be used for intake and compression.

Carrying the oxidizer and working fluid will increase the requirements for storing expendables in the vehicle. The weight and volume will be offset by the lack of requirements for half the cylinders in the engine (smaller block), no cooling system (if cryogenic oxygen used) (no radiator or water pump), no add-on pollution devices (catalytic converters, air pumps), and no intake valve train (or exhaust valve train for solenoid implementation) or starter. In addition no other devices to increase charge to the cylinders are required (no turbochargers or superchargers) because any such effect is equivalent to simply placing a larger charge directly in the cylinder.

Pollution control in an engine that does not use ambient air is simply control of the fuel and other combustion elements used. The close to ideal constituents would be hydrogen, oxygen and water (as a working fluid). Dismissing the energy required to provide these combustion components, no reaction within the cylinder will produce anything but water in the form of steam and any unreacted components.

Cryogenic oxygen is already a highly available industrial chemical. Large tanks exist safely near every hospital. Many smaller tanks are placed in nursing homes and even personal homes. When medically required, airlines make arrangement for oxygen tanks for individuals requiring supplemental oxygen. Oxygen does not burn or explode, although as a gas it strongly supports other materials combustion. Cryogenic oxygen is dangerous due to its low temperature but requires large amounts of heat to become gas and support fire. Hydrogen, which is highly flammable and explosive, is being considered as a motor fuel, even though it is very hard to secure and very dangerous when released into the atmosphere. Oxygen may, therefore, be a much better choice.

The invention claimed is:

1. A true two stroke internal combustion piston engine comprising
- an engine block comprising
  - one or more activation sets comprising a first activation set;
  - one or more cylinders comprising a first cylinder;
  - one or more springs comprising a first spring;
  - one or more exhaust valves comprising a first exhaust valve;
  - one or more pistons; and
  - one or more piston rods; and
- a crankshaft;
- wherein the true two stroke internal combustion piston engine is operative in cycles;

each cycle consists of a power stroke and an exhaust stroke; and the first exhaust valve is characterized by:
- a forced closed condition in which
  - the first exhaust valve is closed by the first activation set;
- an elevated pressure closed condition in which
  - the first activation set is in a neutral position;
  - the first exhaust valve is closed by the elevated pressure in the first cylinder; and
  - the first spring is compressed;
- a reduced pressure open condition in which
  - the first activation set is in the neutral position;
  - the first exhaust valve is opened because of the reduced pressure in the first cylinder; and
  - the reduced pressure is less than an exhaust manifold pressure; and
- a forced open condition in which
  - the first exhaust valve is opened by the first activation set.

2. The true two stroke internal combustion piston engine of claim 1, wherein the one or more activation sets are one or more solenoid sets and the first activation set is a first solenoid set.

3. The true two stroke internal combustion piston engine of claim 1, wherein the reduced pressure open condition starts in the power stroke of said each cycle.

4. The true two stroke internal combustion piston engine of claim 1, wherein movement of the crankshaft is used for precise control of timing.

5. The true two stroke internal combustion piston engine of claim 1, wherein the true two stroke internal combustion piston engine excludes a starter motor.

6. The true two stroke internal combustion piston engine of claim 1, wherein the power stroke begins near a top dead center and ends near a bottom dead center.

7. The true two stroke internal combustion piston engine of claim 6, wherein the exhaust stroke begins near the bottom dead center and ends near the top dead center.

8. The true two stroke internal combustion piston engine of claim 1, wherein said each cycle is characterized by:

a first duration in which
  an injection of fuel, oxidizer and working fluid occurs near a top dead center;
a second duration in which
  the first exhaust valve is closed by the first activation set and an ignition occurs;
a third duration in which
  a charge is fully expended and the reduced pressure is less than the exhaust manifold pressure or near a bottom dead center regardless of pressure;
a fourth duration in which
  the first exhaust valve opens; and
a fifth duration in which
  the first exhaust valve is closed by the first activation set near next top dead center.

9. The true two stroke internal combustion piston engine of claim 8, wherein the true two stroke internal combustion piston engine has a maximum power output twice of that of a conventional four-cycle engine of an equal displacement.

* * * * *